US005785505A

United States Patent [19]

Price

[11] Patent Number: 5,785,505

[45] Date of Patent: Jul. 28, 1998

[54] INTEGRAL FLUID PUMP AND INTERNAL COMBUSTION ENGINE

[75] Inventor: Robert J. Price, Dunlap, Ill.

[73] Assignee: Caterpillar Inc., Peoria, Ill.

[21] Appl. No.: 729,662

[22] Filed: Oct. 21, 1996

[51] Int. Cl.[6] ..... F02B 33/10

[52] U.S. Cl. ..... 417/364; 417/380; 417/568; 123/71 R

[58] Field of Search ..... 417/364, 380, 417/568; 123/71 R

[56] References Cited

U.S. PATENT DOCUMENTS

| | | | |
|---|---|---|---|
| 332,312 | 12/1885 | Wilcox | 123/62 |
| 1,039,539 | 9/1912 | Jackel | 417/380 X |
| 2,610,785 | 9/1952 | Carlson | 417/343 |
| 2,625,144 | 1/1953 | Stewart | 417/470 |
| 2,708,069 | 5/1955 | Olson . | |
| 2,949,858 | 8/1960 | Costley | 417/343 |
| 3,208,439 | 9/1965 | Ulbing | 123/46 |
| 3,216,651 | 11/1965 | King et al. | 417/364 |
| 3,361,338 | 1/1968 | Carleton . | |
| 3,414,187 | 12/1968 | McMullin et al. | 417/364 |
| 3,916,771 | 11/1975 | Nendzig et al. | 417/568 X |
| 4,205,638 | 6/1980 | Vlacancinch | 123/71 R |
| 4,620,836 | 11/1986 | Brandl | 417/364 |
| 4,700,663 | 10/1987 | Dunn | 123/1 |
| 4,841,921 | 6/1989 | Yang | 123/71 |
| 4,992,031 | 2/1991 | Sampo | 417/364 |
| 5,267,843 | 12/1993 | Waldrop | 417/364 |
| 5,556,262 | 9/1996 | Achten et al. | 417/364 |

*Primary Examiner*—Timothy Thorpe
*Assistant Examiner*—Ted Kim
*Attorney, Agent, or Firm*—Alan J. Hickman

[57] ABSTRACT

An integral fluid pump is disposed in the cylinder head of an internal combustion engine is directly driven by an engine piston and provides fluid flow to a fluid system. First and second check valves are connected to the cylinder head and control fluid flow between a reservoir, the fluid pump, the fluid system. The integral fluid pump is particularly suited for providing fluid flow to an engine lubricating system.

3 Claims, 3 Drawing Sheets

92
90
88
86
78
87
87
18
66
10'
80
82
76
14
82
34
24
38
84
20
30
26
SYSTEM
36
38
36
32
28
58
22
28
60
54
52
72
106
104
108
68
64
110
70
44
16
56
112
42
40
62
46
12
48
50

INTEGRAL FLUID PUMP AND INTERNAL COMBUSTION ENGINE

TECHNICAL FIELD

This invention relates to a fluid pump and more particularly to a fluid pump arrangement that is integral with and disposed in the cylinder head of an internal combustion engine.

BACKGROUND ART

Internal combustion engines utilize low pressure fluid pumps to provide pressurized fluid flow to, for example, lubricate various parts of the engine such as the crank shaft journal and rod bearings. These fluid pumps are often mounted on the engine within the engine oil. The fluid pump is usually a gear type pump driven by a gear set connected to a rotating engine member, for example, the engine crankshaft.

It is known to mount fluid pumps of either the rotary or reciprocating type externally on an internal combustion engine and drive them by the engine in an assortment of ways. One typical arrangement for driving a pump utilizes pulleys and a belt. In such an arrangement one pulley is connected to a rotary output of the engine and another pulley is connected to a pump drive shaft. The belt is connected to the two pulleys and transfers the rotary output from the engine driven pulley to the pump driving pulley. In other applications the externally mounted pumps are driven by a gear set operatively connected to a rotatable member such as a crankshaft, camshaft and the like.

Such pump and drive arrangements of the type previously described tend to be noisy, bulky, expensive, inefficient and require a substantial number of parts. Also, frequent maintenance and part replacement is a common occurrence.

It would be advantageous to be able to provide a pump arrangement that was capable of directly utilizing the reciprocal motion of the engines pistons and eliminating the need for a pump drive train of any of the types discussed above. It would also be advantageous to provide a pump arrangement that was compact in design and one that capitalized on using parts of the existing engine structure.

The present invention is directed to overcoming one or more of the problems as set forth above.

DISCLOSURE OF THE INVENTION

An integral fluid pump and internal combustion engine arrangement includes an cylinder head and a fluid pumping piston. The cylinder head of the engine has first and second spaced sides and a fluid pumping piston receiving bore disposed in the cylinder head. The fluid pumping piston is disposed in and reciprocally movable in the fluid pumping piston receiving bore. First and second check valves are connected in fluid communication with the fluid pumping piston receiving bore. One of the first and second check valves passes fluid flow to the fluid pumping piston receiving bore and the other of the first and second check valves passes fluid flow from the fluid pumping piston receiving bore. A cylinder block has a cylinder bore and an engine piston disposed in and slidably movable in the cylinder bore. The cylinder block is engageable with the cylinder head and is connected to the cylinder head. An engine piston is disposed in and reciprocally movable in the cylinder bore. A drive member disposed between the fluid pumping and engine pistons is reciprocally movable in response to reciprocal movement of the engine piston to reciprocally move the fluid pumping piston. The fluid pumping piston pumps fluid from the fluid pumping piston bore past the second check valve.

BEST MODE FOR CARRYING OUT THE INVENTION

Figure 1:
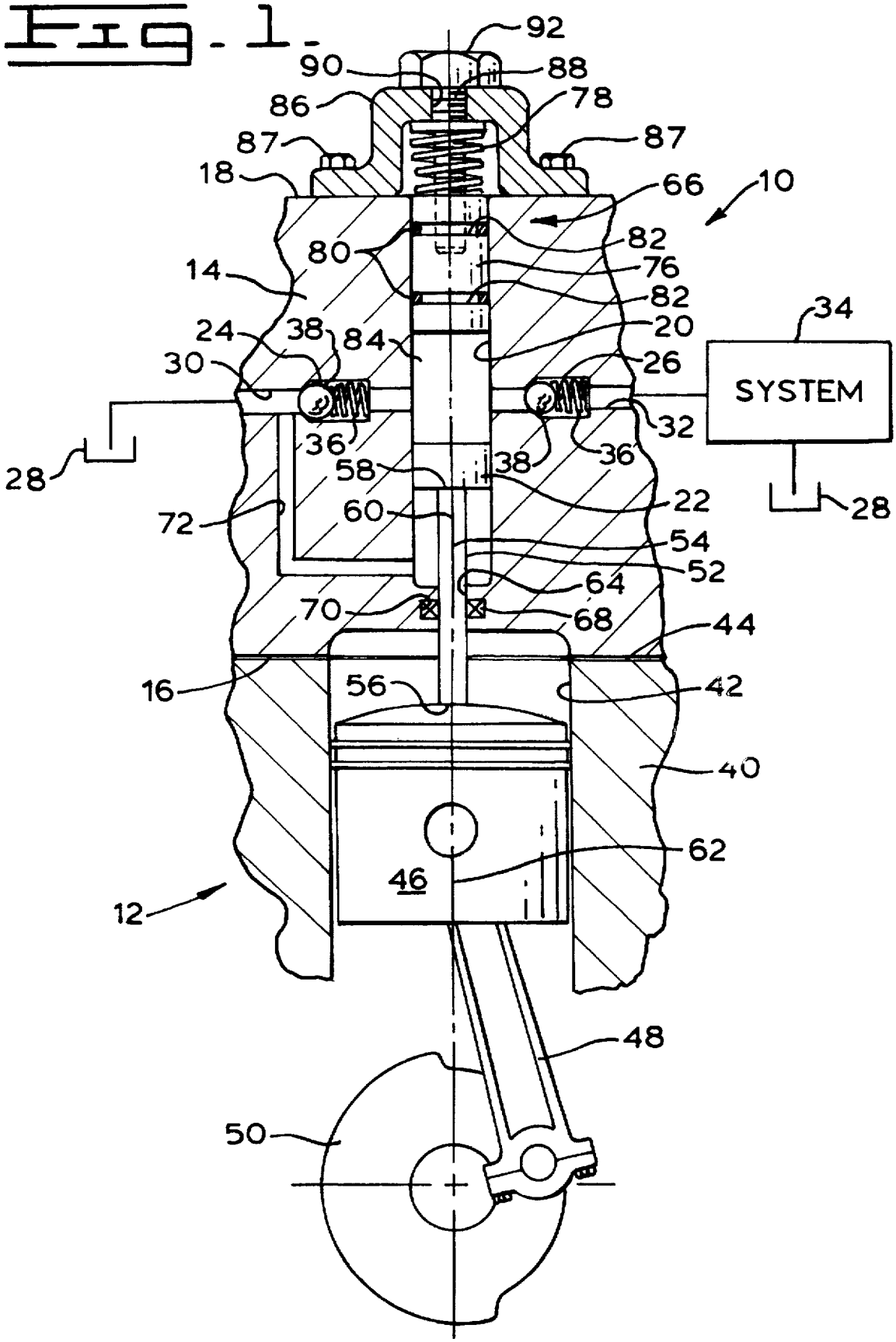
FIG. 1 is a diagrammatic cross sectional view of an embodiment of the present invention showing an integral fluid pump and internal combustion engine arrangement.

With reference to the drawings and particularly FIG. 1, an integral fluid pump and internal combustion engine arrangement 10 is shown. The internal combustion engine 12 has a cylinder head 14. The cylinder head 14 has first and second spaced apart sides 16,18 and a fluid pumping piston receiving bore 20 disposed in the cylinder head 14. A fluid pumping piston 22 is disposed in and reciprocally movable in the fluid pumping piston receiving bore 20. The fluid pumping piston 22 is adapted to pressurize and pass fluid from the fluid pumping piston receiving bore 20. The fluid pumping piston receiving bore 20 is oriented axially transverse the first side 16 of the cylinder head 14.

First and second check valves 24,26 are connected in fluid communication with the fluid pumping piston receiving bore 20. The first check valve 24 passes fluid flow from a reservoir 28 to the fluid pumping piston receiving bore 20 and the second check valve 26 passes fluid flow from the fluid pumping piston receiving bore 26.

A first fluid passing passageway 30 is disposed in the cylinder head 14 and opens into the fluid pumping piston receiving bore 20. The first fluid passing passageway 30 is connected to the reservoir 28. The first check valve 24 is located in the first fluid passing passageway 30 of the cylinder head 14 between the reservoir 28 and the fluid pumping piston receiving bore 20.

A second fluid passing passageway 32 is disposed in the cylinder head 14 and opens into the fluid pumping piston receiving bore 20. The second check valve 26 is located in the second fluid passing passageway 32 of the cylinder head 14 between a fluid system 34, such as, an engine lubrication system, fuel injector system and other suitable fluid systems and the fluid pumping piston receiving bore 20.

The first and second check valves 24,26 each include a spring 36 and a ball 38 and are biased to a closed fluid blocking position by the spring 36. A positive differential in the fluid pressure in the fluid pumping piston receiving bore 20 relative to the fluid pressure in the second fluid passing passageway 32, between the second check valve 26 and the fluid pumping piston 22, unseats the ball 38 of the second check valve 26 against the closing force of the spring 36. A positive differential in fluid pressure in the first fluid passing passageway 30 between the reservoir 28 and first check valve 24 and the fluid pumping piston receiving bore 20 causes the ball 38 of the first check valve 24 to unseat against the closing force of the spring 36.

The internal combustion engine 12 includes a cylinder block 40 having a cylinder bore 42. The cylinder block 40 is connected to and engageable with the first side 16 of the cylinder head 14 and the cylinder bore 42 is open to the cylinder head 14. A head gasket 44 may be provided between the cylinder head 14 and cylinder block 40 without departing from the spirit of the invention. An engine piston 46 of conventional construction is disposed in and reciprocally movable in the cylinder bore 42. A connecting rod 48 and crankshaft 50 are connected to the engine piston 46 in any conventional manner. The crank shaft 50 and connecting rod 48 supports the engine piston 46 for reciprocal movement in the cylinder bore 42.

A drive member 52, disposed between the fluid pumping piston 22 and the engine piston 46, is reciprocally movable in the fluid pumping piston receiving bore 20 in response to reciprocal movement of the engine piston 46. Reciprocal movement of the engine piston 46 forces reciprocal movement of the fluid pumping piston 22 and the causes the pumping of fluid from the fluid pumping piston receiving bore 20 past the second check valve 26.

The drive member 52 includes a cylindrical rod 54 having first and second ends 56,58. The first end 56 is connected to the fluid pumping piston 22 and the second end 54 is either connected to or contactably engageable with the engine piston 46. A central axis of reciprocation 60 of the fluid pumping piston 22 is preferably axially aligned with a central axis 62 of reciprocation of the engine piston 46. The axis 60 is also the longitudinal axis of the fluid pumping piston receiving bore 20 and the axis 62 is also the longitudinal axis of the cylinder bore 42. The cylindrical rod 54 is disposed in and exits the first side 16 of the cylinder head through an aperture 64. In applications where the drive member 52 is free from connection with the engine piston 46, a return spring (not shown) is required to maintain the drive member 52 in engagement with the engine piston 46 and to return the fluid pumping piston 22 during a downward stroke of the engine piston 46. The return spring may be at any suitable location, such as, between the fluid pumping piston 22 and the hereinafter discussed pressure maintaining means 66.

A seal 68 is disposed about the rod 54 and in an annular groove 70 located in the aperture 64 disposed in the cylinder head 14 between the fluid pumping piston receiving bore 20 and the first side 16 of the cylinder head 14. The seal 68 engages the cylindrical rod 54, blocks fluid from leaking into the cylinder bore 42 and blocks gasses from entering the fluid pumping piston receiving bore 20. The seal 68 is selected from one of the many commercially available seals capable of operating in such an environment and includes but is not limited to lip type, ring or other suitable seals or combinations thereof.

A drain passage 72 is disposed in the cylinder head 14 and connects the fluid pumping piston receiving bore 20 to the first fluid passing passageway 30 and drains leakage fluid from the fluid pumping piston receiving bore 20. As shown, the drain passage 72 connects the cylindrical rod side of the fluid pumping piston 22 to the first fluid passing passageway 30 at a location between the first check valve 24 and the reservoir 28.

A pressure maintaining means 66 is provided for maintaining the fluid pressure in the fluid pumping piston receiving bore 20 at a predetermined pressure during pumping by the fluid pumping piston 22. The means 66 includes a spool 76 slidably movably disposed in the fluid pumping piston receiving bore 20 and a centering spring 78 engageable with the spool 76. The centering spring 78 biases the spool 76 in a direction toward the fluid pumping piston 22 and establishes a resistive force of movement of the spool 76 in the opposite direction. This establishes the volume of a pumping chamber 84 in the fluid pumping piston receiving bore 20 located between the spool 76 and the fluid pumping piston 22. Seals 80, of any suitable type, such as o-ring seals, are disposed in annular grooves 82 in the spool 76. These seals 80 prevent fluid leakage past the spool 76 and from exiting the fluid pumping piston receiving bore 20.

A cover 86 is connected to the cylinder head 14 and closes the opening of the fluid pumping piston receiving bore 20 at the second side 18 of the cylinder head 14. The cover 86 may be connected to the cylinder head 14 in any suitable manner, such as by threaded fasteners 87, by a threadable connection (not shown), and the like. In the embodiment shown in FIG. 1, the centering spring 78 is located between the spool 76 and the cover 86 and engageable with the spool 76 and cover 86.

An adjustment screw 88 is screw threadably connected to the spool 76 and rotatable relative to the cover 86 and the spool 76. The adjustment screw 88 passes through a hole 90 in the cover 86 and provides external access to a head 92 of the screw 88 for adjustment purposes. The adjustment screw 88 slidably axially moves the spool 76 in the fluid pumping piston receiving bore 20 during adjustment screw 88 rotation and thereby changes the resistive force of the centering spring 78 acting on the spool 76.

Figure 2:
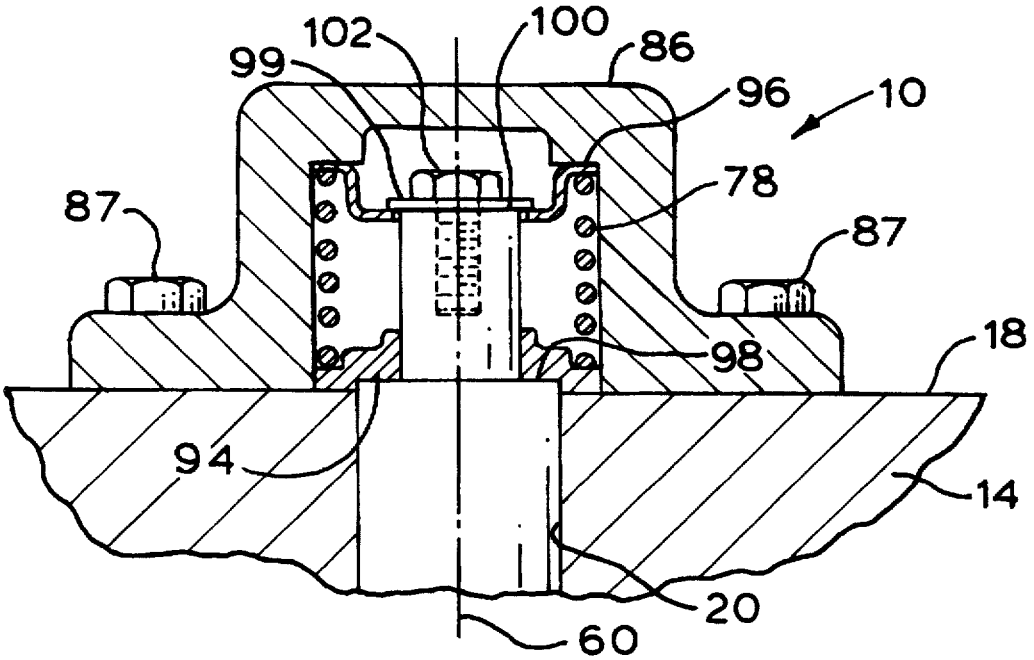
FIG. 2 is a diagrammatic enlarged detail of an alternate embodiment of a portion of the fluid pump of the integral fluid pump and internal combustion engine arrangement.

As best seen in FIG. 2, an alternate embodiment of the pressure maintaining means 66 of FIG. 1, the centering spring 78 is disposed substantially coaxially about the spool 76 engaged with first and second spaced apart cups 94,96. The first cup 94 is engaged with a shoulder 98 on the spool 76 and the second side 18 of the cylinder head 14. The second cup 96 is engaged with the cover 86 and with a washer 99 connected to an end 100 of the spool 76 by a threaded fastener 102 screwthreadably connected to the spool 76 at the end 100. The centering spring 78 establishes a predetermined axial position of the spool 76 and the volume of the chamber 84. Axial movement of the spool 76 occurs when the fluid force in the chamber 84 is greater than the spring force. This movement changes the volume of the chamber 84 and thereby reduces the pressure to maintain the pressure constant. In this embodiment there are no parts which extend externally from the cover.

Figure 3:
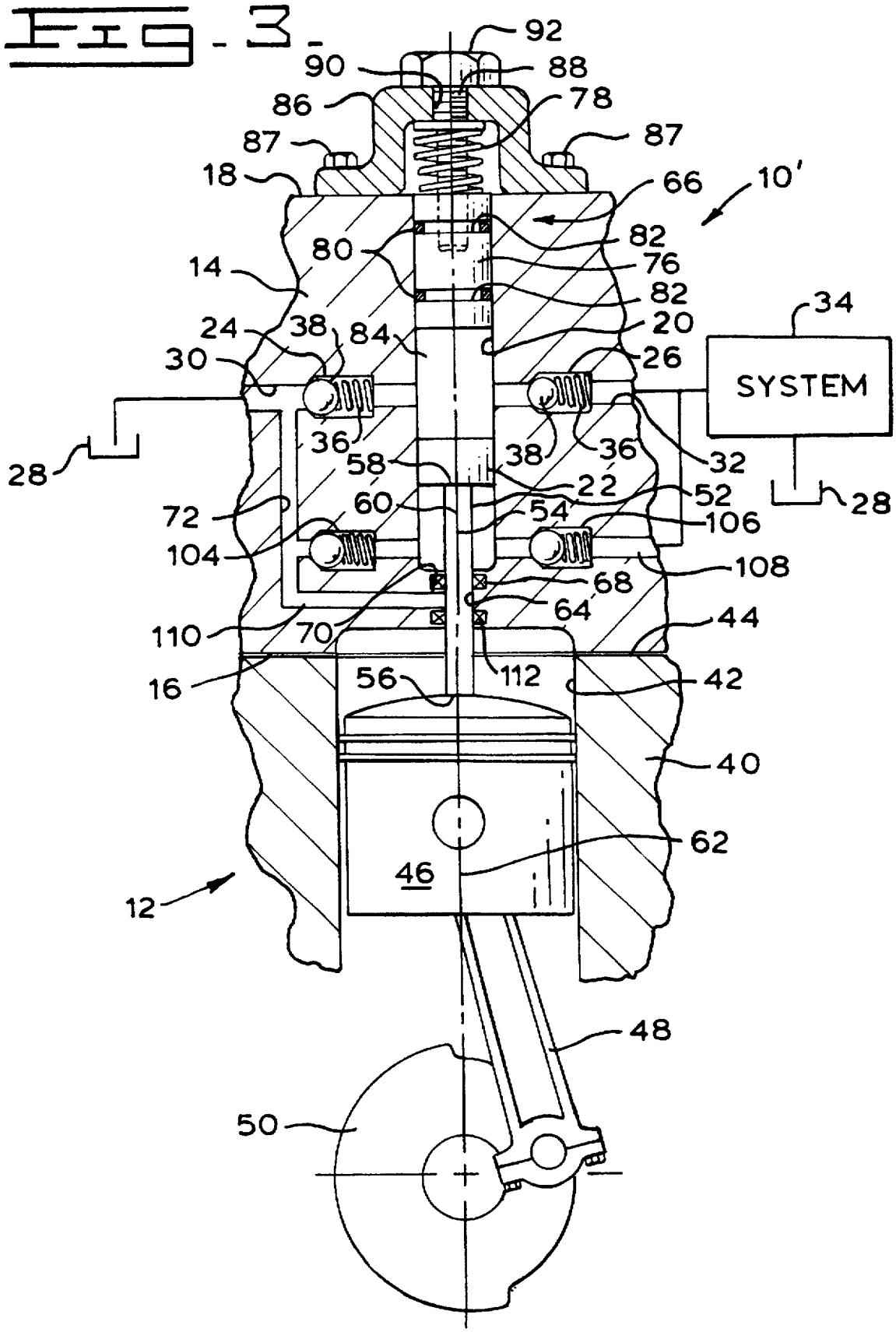
FIG. 3 is a diagrammatic cross-sectional view of an alternate embodiment of the integral fuel pump and internal combustion engine arrangement.

As best seen in FIG. 3, an alternate embodiment integral fuel pump and internal combustion engine arrangement 10' is shown. The arrangement 10' is identical to the arrangement 10 with the exception that the arrangement 10' is double acting and pumps pressurized fluid flow to the system 34 from either the head or drive member 52 sides of the pumping piston 22. In this embodiment, the fluid pumping piston 22 pumps in both directions of reciprocal movement in the receiving bore 20. To accomplish double acting pumping, a check valve 104 is added to passage 72 and a check valve 106 is added to a passage 108 which is connected to the system 34. Flow from the reservoir 28 is passed by the conduit 72 past the check valve 104 and into the chamber 84 on the drive member side of the pumping piston 22. Fluid in the chamber 84 on the drive member side 52 of the pumping piston 22 is forced out of the drive member side 52 past check valve 106 and into the system 34 during movement of the fluid pumping piston 22 in a direction toward the engine piston 46. Filling of the passage 84 on the drive member side 52 is achieved during movement of the pumping piston 22 in a direction towards the pressure maintaining means 66. A drain passage 110 is connected to conduit 72 drains the area between the seals 68 and 112.

It should be noted that the above discussion applies to an internal combustion engine 12 having multiple cylinder.

Therefore, one or more integral fluid pumps may be provided for single or multiple cylinders without departing from the invention.

INDUSTRIAL APPLICABILITY

With reference to the drawings, particularly FIG. 1, as the engine piston 46 moves upwardly in the cylinder bore 42 toward the first side 16 of the cylinder head 14, the drive member 52 which is directly engaged with or connected to the engine piston 46 is forced to move upwardly. This movement causes the fluid pumping piston 22 to pressurize the fluid in the fluid pumping piston receiving bore 20 and force fluid to flow through the second fluid passing passageway 32 and to the fluid system 34. The force of this fluid pressure unseats the second check valve 26 against the bias of the spring 36. During this pumping, the first check valve 24 remains closed as the pumping pressure is higher than the pressure of the fluid on the reservoir 28 side of the first check valve 24.

Upon completion of the upward stroke of the engine piston 46 a reversal in the direction of movement of the engine piston 46 takes place and downward movement occurs. During this downward movement, the fluid pumping piston 22, under the influence of the return spring (not shown) or the connection of the cylindrical rod 54 with the engine piston, follows the downward movement of engine piston until a reversal of the engine piston 46 occurs and an upward stroke begins. During the downward stroke, the fluid pumping piston receiving bore 20 fills with fluid supplied from the reservoir 28. This fluid flow passes the first check valve 24 and flows into the fluid pumping piston receiving bore 20. Since the pressure in the second fluid passing passageway 32, on the system side of the second check valve 26, is greater than the fluid pressure in the fluid pumping piston receiving bore 20, the second check valve 26 remains closed during filling of the fluid pumping receiving bore 20.

The spool 76 responds to the fluid pressure in the fluid pumping piston receiving bore 20 (chamber 84) and moves to increase or decrease the volume in the chamber 84 to maintain the fluid pressure substantially constant. The spool moves upwardly toward the cover 86, from a neutral unloaded position, as shown in FIGS. 1 and 2, and compresses the centering spring 78 in response to an increase in fluid pressure in the chamber 84. As shown in FIG. 2, the spool 76, washer 99, and first cup 94 move upwardly towards the cover 86 and second cup 96 and compresses the centering 78 spring with increasing pressure in the fluid pumping piston receiving bore 20. Adjustment of the force of centering spring 78 may be achieved by rotation of the adjustment screw 88.

For each revolution of the engine 12, fluid is pumped from the fluid pumping piston receiving bore 20 and supplied to the fluid system 34. Because the fluid pumping piston is directly driven by the engine piston 46, motion transforming devices such as gears and the like are not required. As a result efficient pumping is achieved at a minimum of expense.

Since the cylinder head provides the housing for the fluid pumping piston 22, the cost and the waste associated with additional housing and structures is eliminated. The integration of the fluid pumping piston 22 into the head also reduces the overall package size.

Other aspects, objects and advantages can be obtained from a study of the drawings, the disclosure and appended claims.

I claim:

1. An integral fluid pump and internal combustion engine arrangement, comprising:

a cylinder head having first and second spaced sides and a fluid pumping piston receiving bore disposed in the cylinder head;

a fluid pumping piston disposed in and reciprocally movable in said fluid pumping piston receiving bore;

a first and a second check valve connected in fluid communication with said fluid pumping piston receiving bore, one of the first and second check valves passing fluid flow to said fluid pumping piston receiving bore and the other of said first and second fluid check valves passing fluid flow from said fluid pumping piston receiving bore;

a cylinder block having a cylinder bore is connected to and engageable with the first side of the cylinder head, said cylinder bore being open to the cylinder head;

an engine piston is disposed in and reciprocally movable in the cylinder bore;

a drive member disposed between said fluid pumping and engine pistons and reciprocally movable in response to reciprocal movement of said engine piston to reciprocally move said fluid pumping piston, said fluid pumping piston pumping fluid from said fluid pumping piston bore past said second check valve; and means for maintaining the fluid in said fluid pumping piston receiving bore at a predetermined pressure during pumping thereof by said fluid pumping piston, said maintaining means including a spool slidably movably disposed in the fluid pumping piston receiving bore, and a spring engageable with the spool and biasing the spool in a direction toward said fluid pumping piston.

2. An integral fluid pump and internal combustion engine arrangement, comprising:

a cylinder head having first and second spaced sides and a fluid pumping piston receiving bore disposed in the cylinder head, said fluid pumping piston receiving bore opening at the second side of the cylinder head;

a fluid pumping piston disposed in and reciprocally movable in said fluid pumping piston receiving bore;

a first and a second check valve connected in fluid communication with said fluid pumping piston receiving bore, one of the first and second check valves passing fluid flow to said fluid pumping piston receiving bore and the other of said first and second fluid check valves passing fluid flow from said fluid pumping piston receiving bore;

a cylinder block having a cylinder bore is connected to and engageable with the first side of the cylinder head, said cylinder bore being open to the cylinder head;

an engine piston is disposed in and reciprocally movable in the cylinder bore;

a drive member disposed between said fluid pumping and engine pistons and reciprocally movable in response to reciprocal movement of said engine piston to reciprocally move said fluid pumping piston, said fluid pumping piston pumping fluid from said fluid pumping piston bore past said second check valve;

a spool slidably movably disposed in the fluid pumping piston receiving bore;

a spring engageable with the spool and biasing the spool in a direction toward said fluid pumping piston;

a cover connected to the cylinder head and closing the fluid pumping piston receiving bore opening at the second side of the cylinder head, said spring being operatively connected between the spool and the cover; and an adjustment screw connected to the spool and rotatable relative to the cover, said adjustment screw slidably axially moving the spool in the fluid pumping piston receiving bore during adjustment screw rotation and thereby changing the force of the spring acting on the spool.

3. An integral fluid pump and internal combustion engine arrangement, comprising:

a cylinder head having first and second spaced sides and a fluid pumping piston receiving bore disposed in the cylinder head;

a fluid pumping piston disposed in and reciprocally movable in said fluid pumping piston receiving bore located within the cylinder head;

a first and a second check valve connected in fluid communication with said fluid pumping piston receiving bore, one of the first and second check valves passing fluid flow to said fluid pumping piston receiving bore and the other of said first and second fluid check valves passing fluid flow from said fluid pumping piston receiving bore;

a cylinder block having a cylinder bore and being connected to and engageable with the first side of the cylinder head, said cylinder bore being open to the cylinder head;

an engine piston being disposed in and reciprocally movable in the cylinder bore located within the cylinder block, said fluid pumping piston and said engine piston each having axially aligned axes of reciprocal movement; and a drive member disposed between said fluid pumping and engine pistons and reciprocally movable in response to reciprocal movement of said engine piston to reciprocally move said fluid pumping piston, said drive member including a rod, said rod having first and second ends and being connected at said first end to said fluid pumping piston and engageable at said second end with said engine piston;

a seal disposed about the rod and in a groove located in the cylinder head between the fluid pumping piston receiving bore and the first side of the cylinder head, said seal blocking fluid from leaking into the cylinder bore;

a first fluid passing passageway disposed in said cylinder head and opening in said fluid pumping piston receiving bore, a drain passage disposed in the cylinder head and connecting the fluid pumping piston receiving bore to the first fluid passing passageway and draining leakage fluid from the fluid pumping piston receiving bore, said fluid pumping piston pumping fluid from said fluid pumping piston bore past said second check valve.

* * * * *